US011905485B2

(12) United States Patent
De Feo et al.

(10) Patent No.: US 11,905,485 B2
(45) Date of Patent: Feb. 20, 2024

(54) LUBRICANT COMPOSITION AND USE AS A LUBRICANT ADDITIVE OF GUANIDINIUM-BASED IONIC LIQUIDS

(71) Applicant: TOTAL MARKETING SERVICES, Puteaux (FR)

(72) Inventors: Modestino De Feo, Solaize (FR); Thomas Schubert, Bad Wimpfen (DE); Boyan Iliev, Heilbronn (DE)

(73) Assignee: TOTAL MARKETING SERVICES, Puteaux (FR)

( * ) Notice: Subject to any disclaimer, the term of this patent is extended or adjusted under 35 U.S.C. 154(b) by 9 days.

(21) Appl. No.: 17/606,601

(22) PCT Filed: Apr. 15, 2020

(86) PCT No.: PCT/EP2020/060537

§ 371 (c)(1),
(2) Date: Oct. 26, 2021

(87) PCT Pub. No.: WO2020/216655

PCT Pub. Date: Oct. 29, 2020

(65) Prior Publication Data

US 2022/0228083 A1 Jul. 21, 2022

(30) Foreign Application Priority Data

Apr. 26, 2019 (EP) ..... 19305537

(51) Int. Cl.

| | |
|---|---|
| ***C10M 133/22*** | (2006.01) |
| ***C10M 129/50*** | (2006.01) |
| ***C10M 129/54*** | (2006.01) |
| ***C10M 141/06*** | (2006.01) |
| ***C10M 169/04*** | (2006.01) |
| *C10N 30/00* | (2006.01) |
| *C10N 30/04* | (2006.01) |
| *C10N 40/26* | (2006.01) |

(52) U.S. Cl.

CPC ..... *C10M 133/22* (2013.01); *C10M 129/50* (2013.01); *C10M 129/54* (2013.01); *C10M 141/06* (2013.01); *C10M 169/04* (2013.01); *C10M 2203/003* (2013.01); *C10M 2207/141* (2013.01); *C10M 2207/144* (2013.01); *C10M 2207/26* (2013.01); *C10M 2215/26* (2013.01); *C10N 2030/04* (2013.01); *C10N 2030/52* (2020.05); *C10N 2040/26* (2013.01)

(58) Field of Classification Search

CPC ..... C10M 133/22; C10M 129/50; C10M 129/54; C10M 141/06; C10M 169/04; C10M 2203/003; C10M 2207/141; C10M 2207/144; C10M 2207/26; C10M 2215/26; C10M 2203/1006; C10M 2207/021; C10M 2207/023; C10M 2207/028; C10M 2207/122; C10M 2207/124; C10M 2207/126; C10M 2207/129; C10M 2207/146; C10M 2207/262; C10M 2215/14; C10M 163/00; C10M 169/045; C10N 2030/04; C10N 2030/52; C10N 2040/26; C10N 2020/077; C10N 2030/02; C10N 2030/08; C10N 2040/252

See application file for complete search history.

(56) References Cited

U.S. PATENT DOCUMENTS

| | | | | |
|---|---|---|---|---|
| 3,740,338 A * | 6/1973 | Allphin | ..... | C10M 1/08 252/75 |
| 2009/0036334 A1 | 2/2009 | Schwab et al. | | |
| 2011/0077177 A1 | 3/2011 | Doyen | | |
| 2012/0178658 A1 | 7/2012 | Tredget | | |

FOREIGN PATENT DOCUMENTS

| | | | | |
|---|---|---|---|---|
| EP | 388236 B1 * | 11/1993 | ..... | C10L 1/2283 |
| EP | 2 022 840 A2 | 2/2009 | | |

OTHER PUBLICATIONS

Aug. 6, 2020 International Search Report issued in International Patent Application No. PCT/EP2020/060537.

Aug. 6, 2020 Written Opinion of the International Searching Authority issued in International Patent Application No. PCT/EP2020/060537.

* cited by examiner

*Primary Examiner* — Cephia D Toomer

(74) *Attorney, Agent, or Firm* — Oliff PLC

(57) ABSTRACT

Use of a guanidinium-based ionic liquid as detergent in a lubricant composition, notably for lubricating marine engines. A lubricant composition including a guanidinium-based ionic liquid.

15 Claims, No Drawings

LUBRICANT COMPOSITION AND USE AS A LUBRICANT ADDITIVE OF GUANIDINIUM-BASED IONIC LIQUIDS

The invention is directed to the use of guanidinium-based ionic liquids as detergent in a lubricant composition for marine engines. It is also directed to a method for keeping clean (keep-clean) and/or for cleaning (clean-up) at least one of the internal parts of an internal combustion engine, particularly marine engines. It is also directed to a lubricant composition for marine engines comprising guanidinium-based ionic liquids.

STATE OF THE ART

One of the primary functions of lubricants is to decrease friction. Frequently, however, lubricating oils need additional properties to be used effectively. For example, lubricants used in large diesel engines, such as, for example, marine diesel engines, are often subjected to operating conditions requiring special considerations.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; these are in particular sulphur oxides ($SO_2$, $SO_3$), which are then hydrolyzed in contact with the moisture present in the combustion gases and/or in the oil. This hydrolysis generates sulphurous ($HSO_3$) or sulphuric ($H_2SO_4$) acid.

To protect the surface of piston liners and avoid excessive corrosive wear, these acids must be neutralized, which is generally done by reaction with the basic sites included in the lubricant.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a fuel oil, the higher the BN of a marine oil needs to be. This is why marine oils with a BN varying from 5 to 140 mg KOH/g are found on the market.

This basicity is generally provided by detergents that are neutral and/or overbased by insoluble metallic salts, in particular metallic carbonates. The detergents, mainly of anionic type, are for example metallic soaps of salicylate, phenate, sulphonate, carboxylate type etc, which form micelles where the particles of insoluble metallic salts are maintained in suspension. The usual neutral detergents intrinsically have a BN typically less than 150 mg KOH per gram of detergent and the usual overbased detergents intrinsically have a BN in a standard fashion comprised between 150 and 700 mg KOH per gram of detergent. Their percentage by mass in the lubricant is fixed as a function of the desired BN level.

Environmental concerns have led, in certain areas and in particular coastal areas, to requirements relating to the limitation of the level of sulphur in the fuel oils used on ships. Thus, the regulation MARPOL Annex 6 (Regulations for the Prevention of Air Pollution from Ships) issued by the IMO (International Maritime Organization) entered into force in May 2005. It sets a global cap of 4.5% w/w on the sulphur content of heavy fuel oils as well as creating sulphur oxide emission control areas, called SECAs (Sulphur Emission Control Areas). Ships entering these areas must use fuel oils with a maximum sulphur content of 1.5% w/w or any other alternative treatment intended to limit the SOx emissions in order to comply with the specified values. The notation w/w denotes the percentage by weight of a compound relative to the total weight of fuel oil or lubricating composition in which it is included.

Afterwards, the MEPC (Marine Environment Protection Committee) met in April 2008 and approved proposed amendments to the regulation MARPOL Annex 6. From 2012, the restrictions on the maximum sulphur content became more severe with a worldwide maximum content reduced from 4.5% w/w to 3.5% w/w. From 2010, the SECAs (Sulphur Emission Control Areas) became ECAs (Emission Control Areas) with an additional reduction in the maximum permissible sulphur content from 1.5% w/w to 1.0% w/w and the addition of new limits relating to contents of NOx and particles. In 2020, the maximum sulphur content will be further reduced as detailed in the table below.

| | Amendments to MARPOL Annex 6 (MEPC Meeting No. 57 - April 2008) | |
|---|---|---|
| | General limit | Limit for the ECAs |
| Maximum sulphur | 3.5% w/w on fuel content Jan. 1, 2012<br>0.5% w/w on fuel content Jan. 1, 2020 | 1% w/w on fuel content Jul. 1, 2010<br>0.1% w/w on fuel content Jan. 1, 2015 |

Currently, in the presence of fuel oil with a high sulphur content (3.5% w/w and less), marine lubricants having a BN of the order of 100 or less are used. In the presence of a fuel oil with a low sulphur content (0.1% w/w), marine lubricants having a BN of the order of 40 or less are used. In these two cases, a sufficient neutralizing capacity is achieved as the necessary concentration in basic sites provided by the neutral and/or the overbased detergents of the marine lubricant is reached.

Moreover, each of these lubricants has limits of use resulting from the following observations: the use of a high BN cylinder lubricant in the presence of a fuel oil with a low sulphur content (0.1 w/w) and at a fixed lubrication level, creates a significant excess of basic sites (high BN) and a risk of destabilization of the micelles of unused overbased detergent, which contain insoluble metallic salts. This destabilization results in the formation of deposits of insoluble metallic salts (for example calcium carbonate), mainly on the piston crown, and can eventually lead to a risk of excessive wear of the liner-polishing type. For this reason, when low sulphur fuel is used, the TBN of the lubricant should be relatively low, leading also to a reduction in detergent concentration. It is clear that lubricant formulators need other kind of detergent without ash or with reduced ash content. Further, the use of a low BN cylinder lubricant is not sufficient in term of total neutralization capacity in the presence of a fuel oil with a high sulphur content and thus can cause an important risk of corrosion.

There is a need for a marine detergent, which is able to be used in presence of high-sulphur fuels and also low-sulphur fuels and having a good neutralization capacity of sulfuric acid while maintaining a good thermal resistance and thus a lower risk of deposits formation in the hot section of the engine.

There is also a need for marine lubricants having a BN, notably having a BN inferior or equal to BN 70, able to be used in presence of high-sulphur fuels and also low-sulphur fuels and having a good capacity of neutralization of sulfuric acid while maintaining a good thermal resistance and thus a lower risk of deposits formation in the hot section of the engine.

There is also a need for marine lubricants having improved detergency properties: the capacity to keep the engine clean by limiting deposits ("keep-clean" effect) or by reducing the deposits already present in the internal parts of the combustion engine ("clean-up" effect).

An object of the present invention is to provide a lubricant additive overcoming all or part of the aforementioned drawbacks. Another object of the present invention is to provide a lubricant additive whose formulation within lubricant compositions is easy to implement.

Another object of the present invention is to provide a method for lubricating a marine engine, and especially for lubricating a two-stroke marine engine and which can be used with both low-sulphur fuel and high-sulphur fuel.

Another object of the present invention is to provide a method for lubricating a marine engine, and especially for a two-stroke marine engine used with very low-sulphur fuel.

Another object of the present invention is to provide a method for reducing the formation of deposits in the hot section of a marine engine, notably of a two-stroke marine engine.

Surprisingly, the Applicant has found that the introduction of certain types of ionic liquids as detergent in a conventional formulation for a cylinder lubricant, leads to a significant increase in the effectiveness of said conventional lubricant vis-à-vis neutralization of the sulphuric acid formed during the combustion of any type of fuel oils the sulphur content of which is less than 4.5% in a two-stroke marine engine. The improvement in performance relates particularly to the neutralization rate or kinetics of the sulphuric acid formed which is appreciably increased. This performance differential, between a conventional reference lubricant and the same lubricant with added detergent, is characterized by a neutralization effectiveness index measured using the enthalpy test described in the examples below.

Some ionic liquids have been cited in the prior art for their use as additive in lubricants, however, it was not known that guanidinium-based ionic liquids could be used as detergent additive in lubricant composition for marine engines.

US 2012/178658 discloses the use of ionic liquids in a lubricating composition, to reduce the coking and the build-up of sludge in aviation turbines. The ionic liquid can be represented by the formula $C^+A^-$, wherein $C^+$ is a cation and $A^-$ is an anion. Preferred cations are quaternary ammonium cations and phosphonium cations. Preferred anions are fluorinated anions.

EP 2 022 840 discloses the use of guanidinium-based ionic liquids for the lubrication of moving parts in wind turbines, in particular for gear lubrication.

US 2011/077177 discloses a lubricant composition for a marine engine comprising:

- a lubricating base oil,
- at least one overbased detergent based on alkaline or alkaline earth metals, and
- from 0.01% to 10% of one or more surfactant compounds.

The applicant has discovered that guanidinium-based ionic liquids have noteworthy properties as detergent additive in lubricant composition for marine engines, particularly for two-stroke marine engines. The ionic liquids used according to the invention in these lubricant compositions can keep the engine clean, in particular by limiting or preventing the formation of deposits ("keep-clean" effect) or by reducing the deposits already present in the internal parts of the combustion engine ("clean-up" effect).

SUMMARY OF THE INVENTION

The invention concerns the use of a guanidinium-based ionic liquid as detergent in a lubricant composition.

According to a favourite embodiment, the use is for lubricating marine engines.

According to a favourite embodiment, the invention concerns the use of a guanidinium-based ionic liquid as detergent in a lubricating composition for lubricating two-stroke marine engines and four-stroke marine engines, more preferably two-stroke marine engines.

Another object of the invention is a lubricant composition comprising:

- at least one base oil,
- at least one guanidinium-based ionic liquid,
- at least one detergent (Det) selected from neutral and overbased detergents having a Total Base Number according to ASTM D2896 of from 20 to 450 mg KOH/g.

Another object of the invention is a lubricant compositions comprising:

- from 30.0 to 99.95% of at least one base oil,
- from 0.05 to 15.0% of at least one guanidinium-based ionic liquid, the percentages being defined by weight of component as compared to the total weight of the composition.

The invention also relates to a method for lubricating two-stroke marine engines and four-stroke marine engines, more preferably two-stroke marine engines said method comprising application to said marine engine of the lubricant composition as disclosed above.

Another object of the invention is a method for reducing and/or limiting and/or preventing and/or delaying the formation of deposits or for reducing the deposits already present in the internal parts of a combustion engine, in particular a marine engine, comprising the application of a guanidinium-based ionic liquid or the lubricant composition as defined above.

According to a favourite embodiment, the guanidinium-based ionic liquid responds to formula (I):

$$[CAT^+][X^-] \quad (I)$$

wherein $[X^-]$ represents one or more anionic species; $[CAT^+]$ is selected from cations of formula (II):

(II)

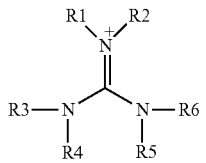

wherein:

R1, R2 are each independently selected from H, a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, R3, R4, R5, R6 are each independently selected from a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, Or any two of (R3, R4) or (R5, R6) form together a methylene chain —$(CH_2)$p-, with p is an integer from 2 to 5.

According to an even favourite embodiment, in formula (II):

R1, R2 are each independently selected from H, a C1-C6 linear or branched alkyl group, R3, R4, R5, R6 are each independently selected from a C1-C6 linear or branched alkyl group.

According to a most preferred embodiment, $[CAT^+]$ is selected from:

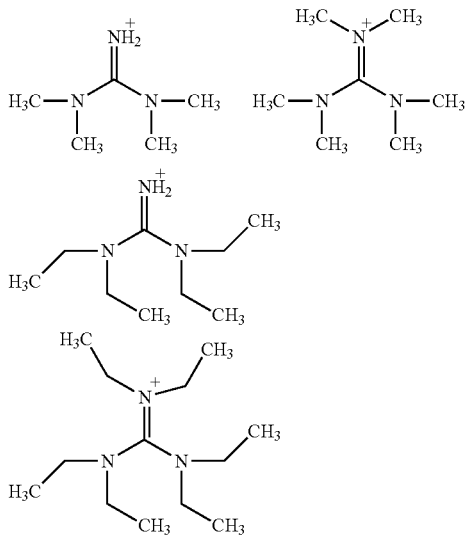

According to a favourite embodiment, $[X^-]$ is selected from:

a) carboxylates Ra—$COO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

b) alcoholates RaRbH$CO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, Rb is selected from H, alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

c) hydroxycarboxylates HO-Rc-$COO^-$, wherein Rc is a di-radical selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom.

According to a more favourite embodiment, $[X^-]$ is selected from: 2-ethylhexanoate, 2-hydroxypropanoate, tert-amylphenolate, isooctylphenolate or dioctylamino phenolate.

According to a favourite embodiment, the lubricant composition comprises at least one detergent (Det) selected from neutral and overbased detergents having a Total Base Number according to ASTM D2896 of from 20 to 450 mg KOH/g.

According to a favourite embodiment, the lubricant composition comprises from 1 to 35% weight of neutral and overbased detergents, with regards to the total weight of the lubricant composition.

According to a favourite embodiment, the percentage by weight of guanidinium-based ionic liquid relative to the total weight of lubricant composition is chosen such that the alternative BN provided by the oil-soluble guanidinium-based ionic liquid represents at least 3% of the BN of said lubricant composition.

According to a favourite embodiment, the lubricant composition has a Total Base Number (TBN) value according to ASTM D2896 of above 5 mg KOH/g.

According to a favourite embodiment, the lubricant composition has a kinematic viscosity at 100° C. superior or equal to 5.6 $mm^2/s$ and inferior or equal to 21.9 $mm^2/s$.

The compounds of formula (I) defined above and hereunder greatly improve the detergency properties of a lubricant composition.

The compound of formula (I) defined above and hereunder allows keeping clean and cleaning up internal parts of engines in a very efficient way.

DETAILED DESCRIPTION

The term "consists essentially of" followed by one or more characteristics, means that may be included in the process or the material of the invention, besides explicitly listed components or steps, components or steps that do not materially affect the properties and characteristics of the invention.

The expression "comprised between X and Y" includes boundaries, unless explicitly stated otherwise. This expression means that the target range includes the X and Y values, and all values from X to Y.

A "ionic liquid" is a salt in the liquid state with organic or inorganic cations and anions. Generally ionic liquids have a melting point below 100° C.

"Alkyl" means a saturated hydrocarbyl chain that can be linear, branched or cyclic.

"Alkenyl" means a hydrocarbyl chain that can be linear, branched or cyclic and comprises at least one unsaturation, preferably a carbon-carbon double bond.

"Aryl" means an aromatic hydrocarbyl functional group. This functional group can be monocyclic or polycyclic. As examples of an aryl group one can mention: phenyl, naphtalen, anthracen, phenanthren and tetracen.

"Aralkyl" means a hydrocarbyl radical comprising an aromatic hydrocarbon functional group, preferably monocyclic, linked to an alkyl chain, the aralkyl group can be linked to the rest of the molecule through the aryl or the alkyl part of the radical.

"Hydrocarbyl" means a compound or fragment of a compound selected from: an alkyl, an alkenyl, an aryl, an aralkyl. Where indicated, some hydrocarbyl groups include heteroatoms.

The Guanidinium-Based Ionic Liquid

The guanidinium-based ionic liquid is a salt of a guanidinium cation with an organic or inorganic anion. Preferably the guanidinium-based ionic liquid is a salt of a guanidinium cation with an organic anion.

The guanidinium-based ionic liquid is advantageously selected from compounds of formula (I):

$$[CAT^+][X^-] \quad (I)$$

wherein $[CAT^+]$ represents a guanidinium ion; $[X^-]$ represents one or more anionic species.

More preferably, $[CAT^+]$ is selected from cations of formula (II):

(II)

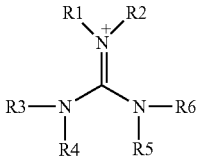

wherein:

R1, R2 are each independently selected from H, a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, R3, R4, R5, R6 are each independently selected from a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, Or any two of (R3, R4) or (R5, R6) form together a methylene chain —$(CH_2)$p-, with p is an integer from 2 to 5.

According to a favourite embodiment, R1=R2.

Advantageously in formula (II) R1, R2 are each independently selected from H, or a C1-C6 linear or branched alkyl group. More advantageously, R1, R2 are each independently selected from H, or a C1-C3 linear or branched alkyl group. Even more advantageously, R1, R2 are each independently selected from H, methyl, ethyl.

Preferably, (R1, R2) are selected from: (—H, —H), (—$CH_3$, —$CH_3$), (—$CH_2CH_3$, —$CH_2CH_3$).

According to a favourite embodiment R3=R4=R5=R6.

According to a favourite embodiment, R3, R4, R5, R6 are each independently selected from a C1-C6 linear or branched alkyl group. More advantageously, R3, R4, R5, R6 are each independently selected from a C1-C3 linear or branched alkyl group. Even more advantageously, R3, R4, R5, R6 are each independently selected methyl, ethyl. Preferably, one of the following conditions is satisfied:

R3=R4=R5=R6=—$CH_3$

R3=R4=R5=R6=—$CH_2$—$CH_3$.

For example, the guanidinium cation can be selected from:

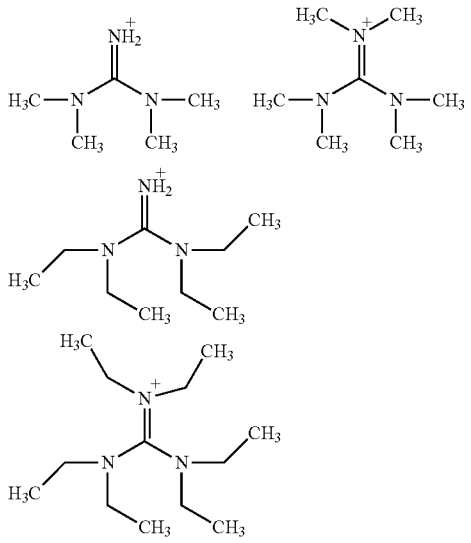

$[X^-]$ represents any counter-ion compatible with the application.

In accordance with the present invention, $[X^-]$ may comprise one or more anions selected from halides, perhalides, pseudohalides, sulphates, sulphites, sulfonates, sulfonimides, phosphates, phosphites, phosphonates, methides, carboxylates, hydroxycarboxylates, alcoholates, azolates, carbonates, carbamates, thiophosphates, thiocarboxylates, thiocarbamates, thiocarbonates, xanthates, thiosulfonates, thiosulfates, nitrate, nitrite, perchlorate, halometallates, amino acids and borates.

According to a favourite embodiment $[X^-]$ represents a counterion selected from:

a) carboxylates Ra—$COO^-$;
b) alcoholates RaRbH$CO^-$;
c) hydroxycarboxylates HO-Rc-$COO^-$;
d) a sulphate anion selected from: $[HSO_4]^-$, $[SO_4]^{2-}$, $[RaOSO_2O]^-$;
e) a sulphite anion selected from: $[HSO_3]^-$, $[SO_3]^{2-}$, $[RaOSO_2]^-$;
f) a sulfonate anion selected from: $[RaSO_2O]^-$;
g) a sulfonimide anion selected from: $[(RaSO_2)_2N]^-$;
h) a phosphate anion selected from: $[H_2PO_4]^-$, $[HPO_4]^{2-}$, $[PO_4]^{3-}$, $[RaOPO_3]^{2-}$, $[(RaO)_2PO_2]$,
i) a phosphite anion selected from: $[H_2PO_3]^-$, $[HPO_3]^{2-}$, $[RaOPO_2]^{2-}$, $[(RaO)_2PO]^-$;
j) a phosphonate anion selected from: $[RaPO_3]^{2-}$, [RaP(O)(ORa)O]$^-$;
k) a methide anion selected from: $[(RaSO_2)_3]^-$;
l) a borate anion selected from: bisoxalatoborate, bismalonatoborate;
m) an azolate anion selected from: 3,5-dinitro-1,2,4-triazolate, 4-nitro-1,2,3-triazolate, 2,4-dinitroimidazolate, 4,5-dinitroimidazolate, 4,5-dicyano-imidazolate, 4-nitroimidazolate, tetrazolate;
n) a sulfur-containing anion selected from: thiocarbonates (for example $[RaOCS_2]$); thiocarbamates (for example $[Ra_2NCS_2]^-$); thiocarboxylates (for example $[RaCS_2]^-$); thiophosphates (for example $[(RaO)_2PS_2]^-$); thiosulfonates (for example $[RaS(O)_2S]^-$); and thiosulfates (for example $[RaOS(O)_2S]^-$; and o) a nitrate ($[NO_3]^-$) or nitrite ($[NO_2]^-$) anion;

wherein

Ra, is selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom, Rb is selected from H, alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom, Rc is a di-radical selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom.

According to an embodiment, $[X^-]$ comprises one or more anions selected from sulphates, sulphites, sulfonates, sulfonimides, phosphates, phosphites, phosphonates, methides, carboxylates, hydroxycarboxylates, alcoholates, azolates, carbonates, carbamates, thiophosphates, thiocarboxylates, thiocarbamates, thiocarbonates, xanthates, nitrate, nitrite, amino acids and borates.

Advantageously, $[X^-]$ comprises one or more anions selected from carboxylates, hydroxycarboxylates, alcoholates.

According to an even more favourite embodiment $[X^-]$ represents a counterion selected from:

a) carboxylates Ra—$COO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

b) alcoholates $RaRbHCO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, Rb is selected from H, alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

c) hydroxycarboxylates HO-Rc-$COO^-$, wherein Re is a di-radical selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom.

When $[X^-]$ represents a carboxylate Ra—$COO^-$, advantageously Ra is selected from alkyl and alkenyl groups comprising from 6 to 15 atoms of carbon, aryl groups comprising from 6 to 15 atoms of carbon, aralkyl groups comprising from 7 to 20 atoms of carbon. For example, $[X^-]$ can represent 2-ethylhexanoate.

When $[X^-]$ represents a hydroxycarboxylate HO-Rc-$COO^-$, advantageously $[X^-]$ is selected from alpha-hydroxy acids, beta-hydroxy acids, gamma hydroxy acids, wherein Rc is a di-radical selected from alkyl and alkenyl groups comprising from 1 to 15 atoms of carbon, aryl groups comprising from 6 to 15 atoms of carbon, aralkyl groups comprising from 7 to 20 atoms of carbon. For example, $[X^-]$ can represent lactate also known as 2-hydroxypropanoic acid.

When $[X^-]$ represents an alcoholate $RaRbHCO^-$, advantageously $[X^-]$ is selected from alkyl phenolates, amino phenolates and mixtures thereof. More advantageously $[X^-]$ is selected from alkyl phenolates comprising from 7 to 20 atoms of carbon and amino phenolates wherein the amine group is substituted with at least one alkyl group comprising from 1 to 18, preferably from 2 to 12 carbon atoms. For example, $[X^-]$ can represent tert-amylphenolate, isooctylphenolate or dioctylamino phenolate.

The molecules of formula (I) can be prepared by any method known to the skilled professional, as illustrated for example in M. G. Bogdanov et al., Z. Naturforsch. 2010, 65b, 37-48; Y. Gao et al., Inorg. Chem. 2005, 44, 1704-1712. An example synthesis is disclosed in the experimental part.

In order to be used in a lubricant composition, the guanidinium-based ionic liquid must preferably be soluble in the base oil, which represents the major part of the lubricant composition. A compound is oil-soluble when it can be solubilized at a concentration of at least 0.01% by weight with regards to the weight of a base oil, at room temperature.

In order to check that the guanidinium-based ionic liquid is oil-soluble, a test is disclosed in the experimental part.

Advantageously, the percentage by weight of guanidinium-based ionic liquid relative to the total weight of lubricant composition is chosen such that the BN provided by these compounds represents a contribution of at least 0.5 milligrams of potash per gram of lubricant, preferably at least 2 milligrams of potash per gram, more preferably at least 3 milligrams of potash per gram, still more preferably from 3 to 40 milligrams of potash per gram of lubricant, to the total BN of said lubricant composition.

Advantageously, the percentage by weight of guanidinium-based ionic liquid relative to the total weight of lubricant composition is chosen such that the alternative BN provided by the oil-soluble guanidinium-based ionic liquid represents at least 3%, preferably at least 5%, preferably from 10 to 50% of the BN of said lubricant composition.

In a preferred embodiment of the invention, the weight percentage of guanidinium-based ionic liquid relative to the total weight of the lubricant composition ranges from 0.05 to 15%, preferably from 0.1 to 12%, advantageously from 0.5 to 10%, even more preferably from 1 to 8%.

Lubricant Composition

The invention is also directed to the use of the guanidinium-based ionic liquids that have been disclosed above as additives in lubricating oil (or lubricant) compositions.

The invention is further directed to some lubricant compositions for two stroke and four stroke marine engines comprising such additives.

Advantageously, the lubricant composition comprises, preferably consists essentially of:

from 30.0 to 99.95% of at least one base oil, from 0.05 to 15.0% of at least guanidinium-based ionic liquid as defined above, the percentages being defined by weight of component as compared to the total weight of the composition.

Even more advantageously, the lubricant composition comprises, preferably consists essentially of:

from 50.0 to 99.0% of at least one base oil from 1.0 to 10.0% of at least one guanidinium-based ionic liquid as defined above, the percentages being defined by weight of component as compared to the total weight of the composition.

According to another favourite embodiment, the invention is directed to a lubricant composition comprising, preferably consisting essentially of:

at least one base oil, at least one guanidinium-based ionic liquid compound as defined above at least one detergent selected from neutral and overbased detergents having a Total Base Number according to ASTM D2896 of from 20 to 450 mg KOH/g.

Advantageously, according to this embodiment, the lubricant composition comprises, preferably consists essentially of:

from 30.0 to 94.0% of at least one base oil, from 0.05 to 15% of at least one guanidinium-based ionic liquid as defined above, from 1 to 35% of at least one detergent selected from neutral and overbased detergents having a Total Base Number according to ASTM D2896 of from 20 to 450 mg KOH/g the percentages being defined by weight of component as compared to the total weight of the composition.

Advantageously, the lubricant composition comprises, preferably consists essentially of:

from 50 to 90% of at least one base oil, from 1 to 10% of at least one guanidinium-based ionic liquid as defined above, from 5 to 35% at least one detergent selected from neutral and overbased detergents having a Total Base Number according to ASTM D2896 of from 20 to 450, the percentages being defined by weight of component as compared to the total weight of the composition.

Base Oils

Generally, the lubricating oil compositions according to the invention comprise as a first component an oil of lubricating viscosity, also called "base oils". The base oil for use herein can be any presently known or later-discovered oil of lubricating viscosity used in formulating lubricating oil compositions for any of the following applications, e.g., engine oils, marine cylinder oils, functional fluids such as hydraulic oils, gear oils, transmission fluids, like for example automatic transmission fluids, turbine lubricants, trunk piston engine oils, compressor lubricants, metal-working lubricants, and other lubricating oil and grease compositions.

Advantageously, the lubricant compositions according to the invention are marine engine lubricating oil compositions; preferably they are 2-stroke marine engine lubricating oil compositions.

Generally, the oils also called "base oils" used for formulating lubricant compositions according to the present invention may be oils of mineral, synthetic or plant origin as well as their mixtures. The mineral or synthetic oils generally used in the application belong to one of the classes defined in the API classification as summarized below:

| | Saturated substance content (weight percent) | Sulfur content (weight percent) | Viscosity Index |
|---|---|---|---|
| Group 1 Mineral oils | <90% | >0.03% | 80 ≤ VI < 120 |
| Group 2 Hydro-cracked oils | ≥90% | ≤0.03% | 80 ≤ VI < 120 |
| Group 3 Hydro-isomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing. Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention have a viscosity grade of SAE-20, SAE-30, SAE-40, SAE-50 or SAE-60 according to the SAEJ300 classification.

Grade 20 oils have a kinematic viscosity at 100° C. of between 5.6 and 9.3 $mm^2/s$.

Grade 30 oils have a kinematic viscosity at 100° C. of between 9.3 and 12.5 $mm^2/s$.

Grade 40 oils have a kinematic viscosity at 100° C. of between 12.5 and 16.3 $mm^2/s$.

Grade 50 oils have a kinematic viscosity at 100° C. of between 16.3 and 21.9 $mm^2/s$.

Grade 60 oils have a kinematic viscosity at 100° C. of between 21.9 and 26.1 $mm^2/s$.

Preferably, the lubricant composition is a cylinder lubricant.

Advantageously, the quantity of base oil in the lubricant composition of the invention is from 30% to 99.95% by weight relative to the total weight of the lubricant composition, preferably from 40% to 99%, more preferably from 50% to 94%.

Detergents

The above-described ionic liquids play the role of detergent in the lubricant composition. They have the advantage of permitting the use of lower amounts of metal detergents. Therefore, the ionic liquids used according to the invention give access to compositions, which have the capacity to neutralize low-sulfur fuel compositions and high-sulfur fuel compositions, but in both cases they avoid the formation of deposits. According to the invention, ionic liquids are preferentially used in combination with at least one detergent that does not belong to the class of ionic liquids, preferably at least one metal detergent.

Detergents, other than the ionic liquids, are typically anionic compounds containing a long lipophilic hydrocarbon chain and a hydrophilic head, wherein the associated cation is typically a metal cation of an alkali metal or alkaline earth metal. The detergents are preferably selected from alkali metal salts or alkaline earth metal (particularly preferably calcium, magnesium, sodium or barium) salts of carboxylic acids, sulphonates, salicylates, naphthenates, as well as the salts of phenates. These metal salts may contain the metal in an approximately stoichiometric amount relative to the anion group(s) of the detergent. In this case, one refers to non-overbased or "neutral" detergents, although they also contribute to a certain basicity. These "neutral" detergents typically have a BN measured according to ASTM D2896, of less than 150 mg KOH/g, or less than 100 mg KOH/g, or less than 80 mg KOH/g of detergent. This type of so-called neutral detergent may contribute in part to the BN of lubricating compositions. For example, neutral detergents are used such as carboxylates, sulphonates, salicylates, phenates, naphthenates of the alkali and alkaline earth metals, for example calcium, sodium, magnesium, barium. When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 450 mg KOH/g of detergent. The metal in excess providing the character of an overbased detergent is in the form of insoluble metal salts in oil, for example carbonate, hydroxide, oxalate, acetate, glutamate, preferably carbonate. In one overbased detergent, the metals of these insoluble salts may be the same as, or different from, those of the oil soluble detergents. They are preferably selected from calcium, magnesium, sodium or barium. The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent. The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate. The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergent and the neutral detergent include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

Advantageously, the composition according to the invention comprises from 1 to 35% weight detergent, more advantageously from 5 to 35%, preferably from 8 to 35%, and even more preferably from 10 to 35%, these percentages being by weight of detergent, other than the ionic liquid, with regards to the total weight of the lubricant composition.

Preferably the composition according to the invention comprises from 1 to 35% weight detergent, more advantageously from 5 to 35%, preferably from 8 to 35%, and even more preferably from 10 to 35%, these percentages being by weight of neutral and overbased detergent, with regards to the total weight of the lubricant composition, preferably selected from neutral and overbased detergents having a Total Base Number according to ASTM D2896 of from 20 to 450 mg KOH/g.

Advantageously, the percentage by weight of neutral and overbased detergents relative to the total weight of lubricant is chosen such that the BN provided by the neutral and overbased detergents represents a contribution of at most 40 milligrams of potash per gram of lubricant, preferably from 5 to 40 milligrams of potash per gram of lubricant, more preferably from 20 to 40 milligrams of potash per gram of lubricant, relative to the total BN of said lubricant.

Additives:

It is optionally possible to substitute the above-described base oils in full or in part by one or more thickening additives whose role is to increase both the hot and cold viscosity of the composition, or by additives improving the viscosity index (VI).

The lubricant composition of the invention may comprise at least one optional additive, chosen in particular from among those frequently used by persons skilled in the art.

In one embodiment, the lubricant composition further comprises an optional additive chosen amongst an anti-wear additive, an oil soluble fatty amine, a polymer, a dispersing additive, an anti-foaming additive or a mixture thereof.

Polymers are typically polymers having a low molecular weight of from 2000 to 50 000 Dalton ($M_n$). The polymers are selected amongst PIB (of from 2000 Dalton), polyacrylates or polymetacrylates (of from 30 000 Dalton), olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers.

Anti-wear additives protect the surfaces from friction by forming a protective film adsorbed on these surfaces. The most commonly used is zinc dithiophosphate or ZnDTP. Also in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or ZnDTP. The preferred compounds are those of the formula $Zn((SP(S)(OR_1)(OR_2))_2$, wherein $R_1$ and $R_2$ are alkyl groups, preferably having 1 to 18 carbon atoms. The ZnDTP is typically present at levels of about 0.1 to 2% by weight relative to the total weight of the lubricating composition. The amine phosphates, polysulphides, including sulphurised olefins, are also widely used anti-wear additives. One also optionally finds nitrogen and sulphur type anti-wear and extreme pressure additives in lubricating compositions, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Dispersants are well known additives used in the formulation of lubricating compositions, in particular for application in the marine field. Their primary role is to maintain in suspension the particles that are initially present or appear in the lubricant during its use in the engine. They prevent their agglomeration by playing on steric hindrance. They may also have a synergistic effect on neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus element. Compounds derived from succinic acid are particularly useful as dispersants in lubricating additives. Also used are, in particular, succinimides obtained by condensation of succinic anhydrides and amines, succinic esters obtained by condensation of succinic anhydrides and alcohols or polyols. These compounds can then be treated with various compounds including sulphur, oxygen, formaldehyde, carboxylic acids and boron-containing compounds or zinc in order to produce, for example, borated succinimides or zinc-blocked succinimides. Mannich bases, obtained by polycondensation of phenols substituted with alkyl groups, formaldehyde and primary or secondary amines, are also compounds that are used as dispersants in lubricants. In one embodiment of the invention, the dispersant content may be greater than or equal to 0.1%, preferably 0.5 to 2%, advantageously from 1 to 1.5% by weight relative to the total weight of the lubricating composition. It is possible to use a dispersant from the PIB succinimide family, e.g. boronated or zinc-blocked.

Other optional additives may be chosen from defoamers, for example, polar polymers such as polydimethylsiloxanes, polyacrylates. They may also be chosen from antioxidant and/or anti-rust additives, for example organometallic detergents or thiadiazoles. These additives are known to persons skilled in the art. These additives are generally present in a weight content of 0.1 to 5% based on the total weight of the lubricating composition.

In one embodiment, the lubricant composition according to the invention may further comprise an oil soluble fatty amine.

The optional additives such as defined above contained in the lubricant compositions of the present invention can be incorporated in the lubricant composition as separate additives, in particular through separate addition thereof in the base oils. However, they may also be integrated in a concentrate of additives for marine lubricant compositions.

Method for Producing a Lubricant Composition, Notably a Marine Lubricant Composition The present disclosure provides a method for producing a lubricant composition, especially a marine lubricant, as above disclosed, comprising the step of mixing the base oil with the guanidinium-based ionic liquid component as defined above, and optionally the additives.

Properties of the Lubricant Composition

The components that have been above disclosed are formulated to provide a composition that advantageously has the following characteristics:

Advantageously, the composition has a Total Base Number (TBN) value according to ASTM D2896 of above 5 mg KOH/g. Preferably, the composition has a Total Base Number (TBN) value of from 5 to 100 mg KOH/g. More advantageously, the composition has a Total Base Number (TBN) value according to ASTM D2896 of above 10 mg KOH/g. Preferably, the composition has a Total Base Number (TBN) value of from 10 to 100 mg KOH/g, better from 15 to 75 mg KOH/g, more preferably from 20 to 60 mg KOH/g, even more preferably from 25 to 40 mg KOH/g.

Preferably, the lubricant composition according to the invention has a kinematic viscosity at 100° C. superior or equal to 5.6 $mm^2/s$ and inferior or equal to 21.9 $mm^2/s$, preferably superior or equal to 12.5 $mm^2/s$ and inferior or equal to 21.9 $mm^2/s$, more preferably superior or equal to 14.3 $mm^2/s$ and inferior or equal to 21.9 $mm^2/s$, advantageously comprised between 16.3 and 21.9 $mm^2/s$, wherein kinematic viscosity at 100° C. is evaluated according to ASTM D 445.

Preferably, the lubricant composition according to the invention is a cylinder lubricant.

Advantageously, the lubricant composition is a cylinder lubricant for two-stroke diesel marine engines and has a viscosimetric grade SAE-40 to SAE-60 equivalent to a kinematic viscosity at 100° C. comprised between 16.3 and 21.9 $mm^2/s$.

Even more advantageously, the lubricating composition is a cylinder oil for two-stroke diesel marine engines and has a viscosimetric grade SAE-50, equivalent to a kinematic viscosity at 100° C. comprised between 16.3 and 21.9 $mm^2/s$.

Typically, a conventional formulation of cylinder lubricant for two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class.

These viscosities may be obtained by mixing additives and base oils, for example base oils containing mineral bases of Group 1 such as Neutral Solvent (for example 150 NS, 500 NS or 600 NS) bases and bright stock. Any other combination of mineral, synthetic bases or bases of plant origin, having, as a mixture with the additives, a viscosity compatible with the chosen SAE grade, may be used.

The Applicant found that it was possible to formulate cylinder lubricants in which a significant part of the BN is provided by oil-soluble guanidinium-based ionic liquid whilst maintaining the level of performance compared with standard formulations with an equivalent BN.

The performances in question here are in particular the capacity to neutralize sulphuric acid, measured using the enthalpy test described in the examples hereafter.

Thanks to the alternative BN provided by the oil-soluble guanidinium-based ionic liquid, which do not form hard deposits leading to wear of the parts, optionally in combination with overbased and neutral detergents, the cylinder lubricants according to the present invention are suitable both for high-sulphur fuel oils and for low-sulphur fuel oils.

Use for Lubricating Engines

The application also relates to the use of a guanidinium-based ionic liquid as above defined for lubricating engines, preferably marine engines. Specifically, the invention is directed to the use of a guanidinium-based ionic liquid as above defined for lubricating two-stroke marine engines and four-stroke marine engines, more preferably two-stroke marine engine.

In particular, the guanidinium-based ionic liquid as above defined is suitable for use in a lubricant composition, as cylinder oil or system oil, for lubricating two-stroke engines and four-stroke marine engines, more preferably two-stroke engines.

The invention particularly relates to the use of a guanidinium-based ionic liquid as defined above as detergent additive in a lubricant composition, notably a marine lubricant.

In particular, the guanidinium-based ionic liquid of the invention is used in a lubricant composition, notably a marine lubricant, to reduce and/or limit and/or prevent and/or delay the formation of deposits (keep clean effect) and/or to reduce the deposits already present in the internal parts of a marine engine (clean-up effect).

The invention also relates to the use of the above-described lubricant composition for lubricating two-stroke engines and four-stroke marine engines, more preferably two-stroke engines.

The application also relates to a method for lubricating two-stroke marine engines and four-stroke marine engines, more preferably two-stroke marine engines said method comprising application to said marine engine of the guanidinium-based ionic liquid or the lubricant composition as disclosed above.

In particular, the guanidinium-based ionic liquid or the lubricant composition is applied to the cylinder wall, typically by a pulse lubricating system or by spraying the guanidinium-based ionic liquid or the lubricant composition onto the piston's rings pack through an injector for lubricating two-stroke engines. It has been observed that applying to the cylinder wall the guanidinium-based ionic liquid or the lubricant composition according to the invention provides increased protection against corrosion and improved engine cleanliness.

The invention also relates to a method for reducing and/or limiting and/or preventing and/or delaying the formation of deposits or for reducing the deposits already present in the internal parts of a combustion engine, in particular a marine engine, comprising the application of a guanidinium-based ionic liquid, notably of guanidinium-based ionic liquid of formula (I) or the lubricant composition as defined above.

Measurement of the Performance Differential Between a Conventional Reference Lubricant and a Lubricant According to the Invention:

This measurement is characterized by a neutralization effectiveness index measured according to the enthalpy test method precisely described in the examples and in which the progress of the exothermic neutralization reaction is monitored by the increase in temperature observed when the lubricant containing the basic sites is placed in the presence of sulphuric acid.

Experimental Part

I—Material and Methods:

Ionic Liquid—1,1,3,3-Tetramethylguanidinium 2-Ethylhexanoate (IL1)

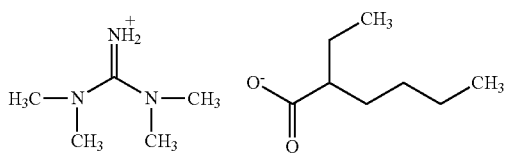

The ionic liquid was prepared by the following method:

Under stirring and cooling 1151.8 g (10 mol, 1.00 eq) of 1,1,3,3-Tetramethylguanidine were slowly added at 0° C. to 1.5 L of Methanol. When the solution was cooled down to room temperature (RT), 1442.1 g (10 mol, 1.00 eq) of 2-ethylhexanoic acid were added slowly and under cooling over a period of 4 h using a piston pump. The temperature of the reaction mixture was kept at all times below 20° C. After completion of the addition, the reaction mixture was stirred at RT for another 24 h, after which the pH of the medium was adjusted through addition of either of 1,1,3,3-Tetramethylguanidine or 2-ethylhexanoic acid to pH 9. To purify the resulting mixture, activated charcoal (50 g) was added and it was further stirred for 13 h at RT. The charcoal was filtrated over a glass filter frit, the solvent evaporated at reduced pressure at 38° C., the slightly yellowish oil was further dried at 35° C. and a vacuum of $1\times10^{-2}$ mbar for 36 h until the water content was below 0.1%, as measured by Karl-Fischer titration.

The base number of IL1 is 214 mg KOH/g according to ASTM D2896.

In order to check that the guanidinium-based ionic liquid is oil-soluble, the following test has been achieved:

100 mL of the lubricant composition comprising the guanidinium-based ionic liquid and the base oil is introduced into two reaction tubes.

One of the tubes is maintained at room temperature (between 15 and 25° C.) and the other reaction tube is placed in an oven at 60° C.

If after one month, the lubricant composition of both reaction tubes is limpid, the guanidinium-based ionic liquid is considered as being soluble in the oil.

Base Oil:

Base oil 1: Group I mineral oils called 600NS, viscosity at 40° C. of 120 cSt measured according to ASTM D7279

Detergent:

Dtgl: phenate of TBN=250 mg KOH/g according to ASTM D2896

Dtg 2: salicylate of TBN=250 mg KOH/g according to ASTM D2896

Additives:

An anti-foaming agent (AF)

II—Preparation of the Lubricant Composition:

The components listed in Table 1 are mixed at 60° C. The percentages disclosed in Table I correspond to weight percent with regards to the total weight of the composition.

TABLE 1

| Composition | $C_1$ (Invention) | Href (Comparative) |
|---|---|---|
| Base oil 1 | 89.57 | 89.7 |
| IL1 | 1.4 | — |
| Dtg 1 | 5.0 | 5.7 |
| Dtg 2 | 4.0 | 4.6 |
| AF | 0.03 | 0.03 |
| TBN (Total base number in mg KOH/g of composition according to ASTM D2896) | 25 | 25 |

Test Method 1—Neutralization Kinetics:

This Example describes the enthalpy test making it possible to measure the effectiveness of neutralization of the lubricants vis-à-vis sulphuric acid, which can be quantified by a dynamic monitoring of the kinetics or rate of the reaction.

Principle: Acid-base neutralization reactions are generally exothermic and it is therefore possible to measure the generation of heat obtained by reacting sulphuric acid with the lubricants to be tested. This heat generation is monitored by temperature evolution over time in a DEWAR type adiabatic reactor. Starting from these measurements, it is possible to calculate an index quantifying the effectiveness of a lubricant with additives according to the present invention compared with a lubricant taken as reference.

This index is calculated with respect to the reference oil to which the value of 100 is given. This is the ratio between the neutralization reaction times of the reference (Sref) and of the measured sample (Smes):

$$\text{Neutralization effectiveness index}=Sref/Smes\times100$$

The values of these neutralization reaction times, which are of the order of a few seconds, are determined from the acquisition curves of the temperature increase as a function of time during the neutralization reaction. The time period S is equal to the difference $t_f$-$t_i$ between the time at the end-of-reaction temperature and the time at the start-of-reaction temperature. The time $t_i$ at the start-of-reaction temperature corresponds to the first temperature increase after stirring has been started. The time $t_f$ at the final temperature of the reaction is that starting from which the temperature signal remains stable for a period of time greater than or equal to half of the reaction time. The lubricant is thus even more effective in that it leads to short neutralization times and therefore to a high index.

Equipment Used: The geometries of the reactor and the stirrer as well as the operating conditions were chosen so that they are situated in the chemical regime, where the effect of the diffusion constraints in the oil phase is negligible. Thus in the configuration of the equipment used, the height of fluid must be equal to the internal diameter of the reactor, and the stirrer screw must be positioned at approximately ⅓ of the height of the fluid. The apparatus is constituted by a cylindrical-type 250 ml adiabatic reactor, of which the internal diameter is 48 mm and the internal height 150 mm, with a stirring rod provided with a screw with inclined blades, 22 mm in diameter; the diameter of the blades is comprised between 0.3 and 0.5 times the diameter of the DEWAR, i.e. from 9.6 to 24 mm. The position of the screw is fixed at a distance of 15 mm from the bottom of the reactor. The stirring system is driven by a motor with a variable speed of 10 to 5000 r.p.m., and a system for acquiring the temperature as a function of time.

This system is suitable for measuring reaction times of the order of 5 to 20 seconds and for measuring a temperature increase of several tens of degrees starting from a temperature of approximately 20° C. to 35° C., preferably approximately 30° C. The position of the system for acquiring the temperature in the DEWAR is fixed. The stirring system is set such that the reaction takes place in the chemical regime: in the configuration of the present experiment, the speed of rotation is set at 2000 r.p.m, and the position of the system is fixed. Moreover, the chemical regime of the reaction is also dependent on the height of the oil introduced into the DEWAR, which must be equal to the diameter of the latter, and which corresponds, within the framework of this experiment, to a mass of 70 g of the lubricant tested.

3.5 g of 95% sulphuric acid concentrate and 70.0 g of lubricant to be tested are introduced into the reactor. After placing the stirring system inside the reactor such that the acid and the lubricant are well mixed and in a manner, which is repeatable over two tests, the acquisition system then the stirring are started in order to monitor the reaction. 3.5 g of acid is introduced into the reactor. Then 70.0 g of lubricant is introduced and heated to a temperature of approximately 30° C. The acquisition system is then started, and then the stirring system is adjusted so as to be situated in the chemical regime.

Implementation of the Enthalpy Test—Calibration:

In order to calculate the effectiveness indices of the lubricants according to the present invention by the method described above, we have chosen to take as a reference the neutralization reaction time measured for a two-stroke marine engine cylinder oil of BN 25 (measured by ASTM D-2896), which does not contain any detergent additive according to the present invention. This oil is obtained from a mineral base with a density at 15° C. comprised between 880 and 900 Kg/m$^3$. A concentrate including a calcium salicylate of BN equal to 250 mg of KOH/g, an antifoaming agent, a calcium phenate of BN equal to 250 mg of KOH/g is added to this base in a quantity necessary to obtain a lubricant of BN 25 mg of KOH/g. The lubricant thus obtained has a viscosity at 100° C. comprised between 12.5 and 16.3 mm$^2$/s. The neutralization reaction time of this oil (referred as Href) is around 100 seconds and its neutralization effectiveness index is fixed at 100.

Implementation of the Neutralization Effectiveness Test

This example describes the influence of the additives according to the invention for a formulation at a constant BN of 25 mg KOH/g. The reference is the BN 25 mg KOH/g, without IL1 according to the present invention, and referenced Href in the previous example.

The samples with additives BN 25 mg KOH/g to be tested are prepared starting from the lubricant without additives reference Href in the previous example. These samples are obtained by mixture in a beaker at a temperature of 60° C., under stirring which is sufficient to homogenize the mixture of the lubricant.

Table 2 below shows the values for the effectiveness indices of the various samples prepared in this way.

TABLE 2

| | BN | Neutralization effectiveness index |
|---|---|---|
| Href | 25 | 100 |
| C1 | 25 | 704 |

Test Method 2—Heat Resistance and Detergency of Lubricant Compositions:

The heat resistance of lubricant compositions according to the invention is evaluated by performing the ECBT test on aged oil.

The heat resistance of the lubricant composition $C_1$ was thus evaluated by means of the ECBT test on aged oil, via which the mass of deposits (in mg) generated under given conditions is determined. The lower this mass, the better the heat resistance and thus the better the cleanliness of the engine.

This test simulates the behavior of the lubricant composition when it is injected onto the hot parts of the engine and especially onto the top of the piston.

The test was performed at a temperature of 310° C.

It uses aluminium beakers, which simulate the form of pistons. These beakers were placed in a glass container; the lubricant composition being maintained at a controlled temperature of about 60° C. The lubricant was placed in these containers, which were themselves equipped with a metal brush partially immersed in the lubricant. This brush is driven in a rotary motion at a speed of 1000 rpm, which creates a projection of lubricant onto the inner surface of the beaker. The beaker was maintained at a temperature of 310° C. by means of a heating electrical resistance, regulated by a thermocouple. This projection of lubricant was continued throughout the test for 12 hours.

A detailed description of this test is given in the publication "Research and Development of Marine Lubricants in ELF ANTAR France—The relevance of laboratory tests—in simulating field performance" by Jean-Philippe ROMAN, MARINE PROPULSION CONFERENCE 2000—AMSTERDAM—29-30 Mar. 2000.

This procedure makes it possible to simulate the formation of deposits in the piston-ring assembly. The result is the weight of deposits measured in mg on the beaker.

The lubricant according to the invention $C_1$ provides 190 mg of deposits whereas the comparative lubricant Href provides 360 mg of deposits.

Thus, the ionic liquids defined in the present invention have a detergency effect since they allow reducing the deposits in pieces of a motor.

The invention claimed is:

1. 1. A method for reducing and/or limiting and/or preventing and/or delaying the formation of deposits or for reducing the deposits already present on internal parts of a marine combustion engine comprising applying a guanidinium-based ionic liquid or a lubricant composition comprising the guanidinium-based ionic liquid to the internal parts of the marine combustion engine, wherein the guanidinium-based ionic liquid corresponds to formula (I):

$$[CAT^+][X^-] \quad (I)$$

wherein $[X^-]$ represents one or more anionic species, $[CAT^+]$ is selected from cations of formula (II):

(II)

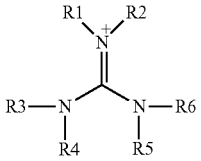

wherein:

R1, R2 are each independently selected from H, a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, R3, R4, R5, R6 are each independently selected from a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, or any two of (R3, R4) or (R5, R6) form together a methylene chain —(CH2)p-, with p is an integer from 2 to 5.

2. The method according to claim 1, wherein the guanidinium-based ionic liquid or the lubricant composition is applied to the cylinder wall of the marine combustion ,engine.

3. The method according to claim 1, wherein in formula (II):

R1, R2 are each independently selected from H, a C1-C6 linear or branched alkyl group, R3, R4, R5, R6 are each independently selected from a C1-C6 linear or branched alkyl group.

4. The method according to claim 3, wherein in formula (II):

R1, R2 are independently selected from the group consisting of H, methyl group and ethyl group, R3, R4, R5, R6 are independently selected from methyl group and ethyl group.

5. The method according to claim 4, wherein $[CAT^+]$ is selected from:

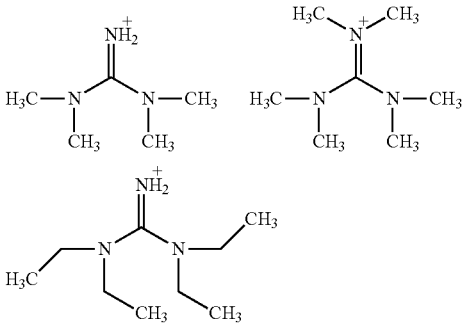

-continued

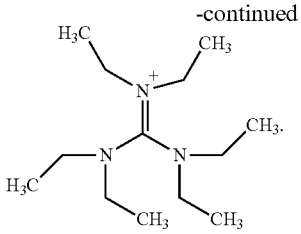

6. The method according to claim 1, wherein $[X^-]$ represents one or more anions selected from the group consisting of carboxylates, hydroxycarboxylates and alcoholates.

7. The method according to claim 6, wherein $[X^-]$ is selected from:

a) carboxylates Ra—$COO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

b) alcoholates $RaRbHCO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, Rb is selected from H, alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

c) hydroxycarboxylates HO-Rc-$COO^-$, wherein Rc is a di-radical selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom.

8. The method according to claim 7, wherein $[X^-]$ is selected from the group consisting of 2-ethylhexanoate, 2-hydroxypropanoate, tert-amylphenolate and isooctylphenolate.

9. A method for lubricating two-stroke marine engines and four-stroke marine engines, said method comprising applying a marine lubricant composition to internal parts of said marine engine, where said marine lubricant composition comprising:

from 30.0 to 94% of at least one base oil, from 0.05 to 15.0% of at least one guanidinium-based ionic liquid, at least one detergent selected from neutral and overbased detergents having a Total Base Number according to ASTM D2896 of from 20 to 450 mg KOH/g the percentages being defined by weight of component as compared to the total weight of the composition wherein the guanidinium-based ionic liquid responds to formula (I):

$$[CAT^+][X^-] \quad (I)$$

wherein

[$X^-$] represents one or more anionic species, [$CAT^+$] is selected from cations of formula (II):

(II)

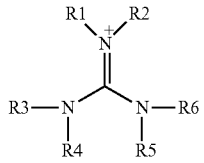

wherein:

R1, R2 are each independently selected from H, a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, R3, R4, R5, R6, are each independently selected from a C1-C30 linear or branched alkyl group, a C3-C8 cycloalkyl group, a C6-C12 aryl group, or a C7-C12 aralkyl group, optionally substituted by a functional group comprising an oxygen and/or a nitrogen atom, or any two of (R3, R4) or (R5, R6) form together a methylene chain —(CH2)p-, with p is an integer from 2 to 5.

10. The method of claim 9 wherein the marine lubricant composition comprises from 1 to 35% weight of neutral and overbased detergents, with regards to the total weight of the lubricant composition.

11. The method according to claim 9, wherein the percentage by weight of guanidinium-based ionic liquid relative to the total weight of lubricant composition is chosen such that the alternative BN provided by the oil-soluble guanidinium-based ionic liquid represents at least 3% of the BN of said lubricant composition.

12. The method according to claims 9, wherein the marine lubricant composition has a Total Base Number (TBN) value according to ASTM D2896 of above 10 mg KOH/g.

13. The method according to claim 9, wherein the marine lubricant composition has a kinematic viscosity at 100° C. superior or equal to 5.6 mm 2/s and inferior or equal to 21.9 mm 2/s.

14. The method according to claim 9, wherein [$CAT^+$] is selected from:

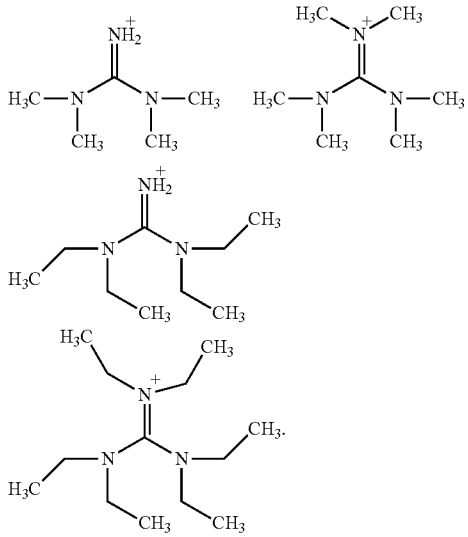

15. The method according to claim 9, wherein [$X^-$] is selected from:

a) carboxylates Ra—$COO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

b) alcoholates $RaRbHCO^-$, wherein Ra is selected from alkyl and alkenyl groups comprising from 1 to 30 atoms of carbon, aryl groups comprising from 6 to 30 atoms of carbon, aralkyl groups comprising from 7 to 30 atoms of carbon, Rb is selected from H, alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom;

c) hydroxycarboxylates HO-Rc-$COO^-$, wherein Rc is a di-radical selected from alkyl and alkenyl groups comprising from 1 to 30 atoms of carbon, aryl groups comprising from 6 to 30 atoms of carbon, aralkyl groups comprising from 7 to 30 atoms of carbon, optionally substituted by a functional group comprising an oxygen and/or a nitrogen atom.

* * * * *